US008206177B2

(12) United States Patent
Chang

(10) Patent No.: US 8,206,177 B2
(45) Date of Patent: Jun. 26, 2012

(54) HDMI CONNECTOR STRUCTURE

(76) Inventor: Nai-Chien Chang, Sanchong (TW)

( * ) Notice: Subject to any disclaimer, the term of this patent is extended or adjusted under 35 U.S.C. 154(b) by 72 days.

(21) Appl. No.: 12/917,539

(22) Filed: Nov. 2, 2010

(65) Prior Publication Data

US 2011/0136384 A1 Jun. 9, 2011

(30) Foreign Application Priority Data

Dec. 4, 2009 (TW) ..... 98222747 U

(51) Int. Cl.
*H01R 13/648* (2006.01)

(52) U.S. Cl. ..... 439/607.35

(58) Field of Classification Search ..... 439/79, 439/76.1, 607.01, 607.02, 607.07–607.09, 439/607.27, 607.35–607.4, 660
See application file for complete search history.

(56) References Cited

U.S. PATENT DOCUMENTS 8,096,834 B2 * 1/2012 Lai et al. ..... 439/607.28
8,137,137 B1 * 3/2012 Chang ..... 439/607.07
8,142,209 B2 * 3/2012 Zhu et al. ..... 439/108
8,162,671 B2 * 4/2012 Matsubara et al. ..... 439/60
8,162,691 B2 * 4/2012 Chang ..... 439/541.5

* cited by examiner

*Primary Examiner* — Khiem Nguyen
(74) *Attorney, Agent, or Firm* — Chun-Ming Shih; HDLS IPR Services

(57) ABSTRACT

An HDMI connector structure includes a base, a circuit board, a chassis and a metal casing. The base includes a containing space, a retaining wall formed at a front end of the containing space, and an opening formed on the retaining wall. The circuit board is installed in the containing space, and an end of the circuit board is passed through the opening and out of the retaining wall, and at least one surface of the circuit board has a plurality of conductive pins, and a transmission line segment is extended from an end of each conductive pin and electrically coupled to a conductive terminal The metal casing includes a hollow main body, and the base is installed in the empty main body, and a front end of the hollow main body is provided for exposing a port from an end of the circuit board.

14 Claims, 6 Drawing Sheets

HDMI CONNECTOR STRUCTURE

FIELD OF THE INVENTION

The present invention relates to a connector, in particular to an HDMI connector structure.

BACKGROUND OF THE INVENTION

In general, a HDMI connector includes a base, a plurality of conductive pins and a metal casing. In a manufacturing process, a thin metal sheet is stamped to produce the conductive pins. After the base made of a plastic material is formed in an injection molding process, the conductive pins are combined with the base, or the conductive pins are placed into a mold and then integrally formed with the base by the injection molding process, such that an end of each conductive pin is fixed onto a tongue plate of the base, and another end of each conductive pin is extended to the exterior of the metal casing after the base is assembled with the metal casing.

Since the base and the conductive pins of the HDMI connector are manufactured separately, small flexible pillar-shaped objects will be produced after the conductive pins are formed by the stamping process, and thus it is not easy to install the HDMI connector into a pin slot of the tongue plate of the base. If the conductive pins are placed into the mold and integrally formed with the base by the injection molding process, and the conductive pins and the base are not connected closely enough, ends of the conductive pins may be warped slightly, such that after a plug of an external HDMI transmission line is inserted, the conductive pins may be crooked or unable to contact with the pins in the plug of the HDMI transmission line, and thus resulting in a failure of transmitting electric signals.

If an electronic component is installed or added inside the HDMI connector or an electronic circuit (including a circuit board) is expanded inside the HDMI connector, the conventional HDMI connector has very limited internal space, such that the electronic component or electronic circuit cannot be added, or after the electronic circuit (including a circuit board) is added into the HDMI connector directly, the new-generation HDMI connector becomes larger and incompatible with the use of other mainboards.

SUMMARY OF THE INVENTION

In view of the aforementioned shortcomings, a primary objective of the present invention is to use a copper-foil circuit on a circuit board to replace the conventional design of the conductive pins formed by stamping. Meanwhile, an electronic component or circuit is manufactured on the same circuit board to make the manufacture of the HDMI connector much easier, when it is necessary to add the electronic component or circuit.

To achieve the foregoing objective, the present invention discloses an HDMI connector structure, comprising:

a base, having a containing space defined therein, a retaining wall formed at a front end of the containing space, and an opening formed on the retaining wall, and the base further including two ribs formed on both sidewalls of the containing space separately, and a slideway formed between the two ribs, and the base further including a bottom tray extended from the bottom of the retaining wall, a gap formed between the retaining wall and the bottom tray, a notch formed on the bottom tray, an engaging portion formed at the bottom of both sidewalls the containing space separately and provided for assembling and coupling the chassis, and a strip-shaped fixing portion separately formed on both sides of the base and inserted into insert slots on both sides of the casing;

a circuit board, installed in the containing space, and having a front side, a back side, a plurality of conductive pins made of a copper foil and disposed between the front and back sides, a transmission line segment extended from an end of the conductive pin, and a soldering hole formed at an end of the transmission line segment and soldered to the conductive terminal;

a chassis, having a tray portion coupled onto the base, a retaining portion bent from an end of the tray portion and coupled to a rear side of the base, a plurality of through holes formed on the tray portion and provided for passing the conductive terminals out of the through holes respectively, and a bump formed separately on both lateral sides of the tray portion and coupled to the engaging portion;

a casing, having a hollow main body, a port formed at a front end of the main body, a plurality of elastic plates disposed at the top and bottom of the port respectively, a folding plate disposed at an end of the hollow main body, an insert slot formed on both lateral sides of the main body separately, such that when the base is assembled in the main body, the fixing portion is inserted into the insert slot, and then the folding plate is bent; and an assembling pin extended from both lateral sides of the main body separately.

DESCRIPTION OF THE PREFERRED EMBODIMENTS

The technical characteristics and contents of the present invention will become apparent with the following detailed description accompanied with related drawings.

Figure 1:
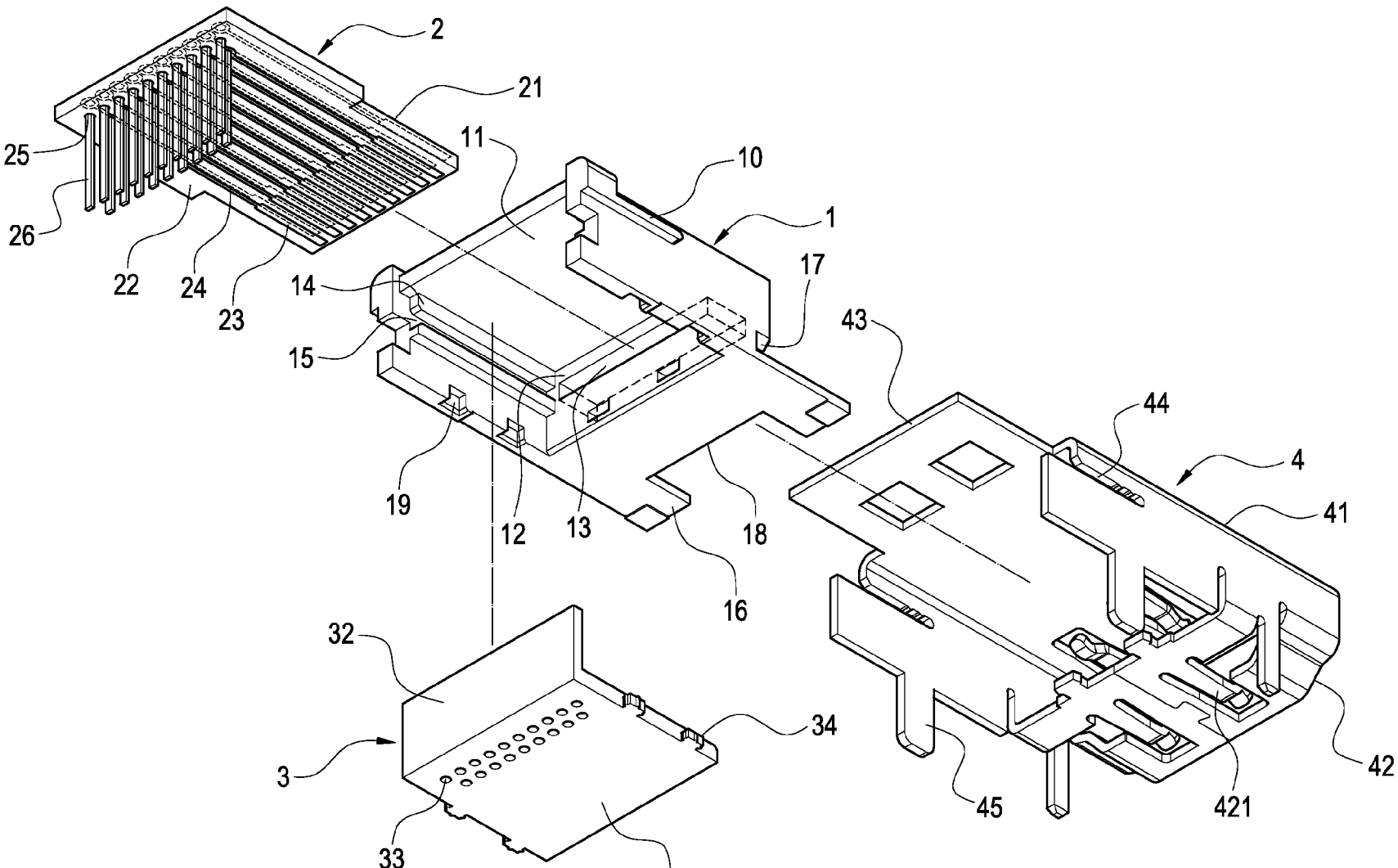
FIG. 1 is an exploded view of a HDMI connector of the present invention.
Figure 2:
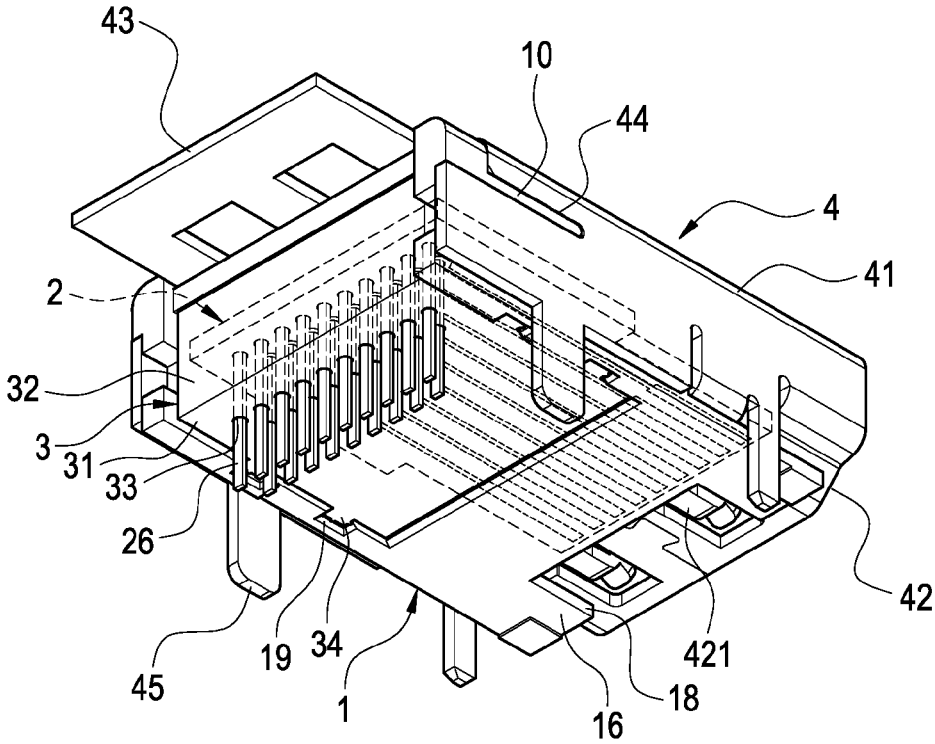
FIG. 2 is a first bottom view of a HDMI connector of the present invention.
Figure 3:
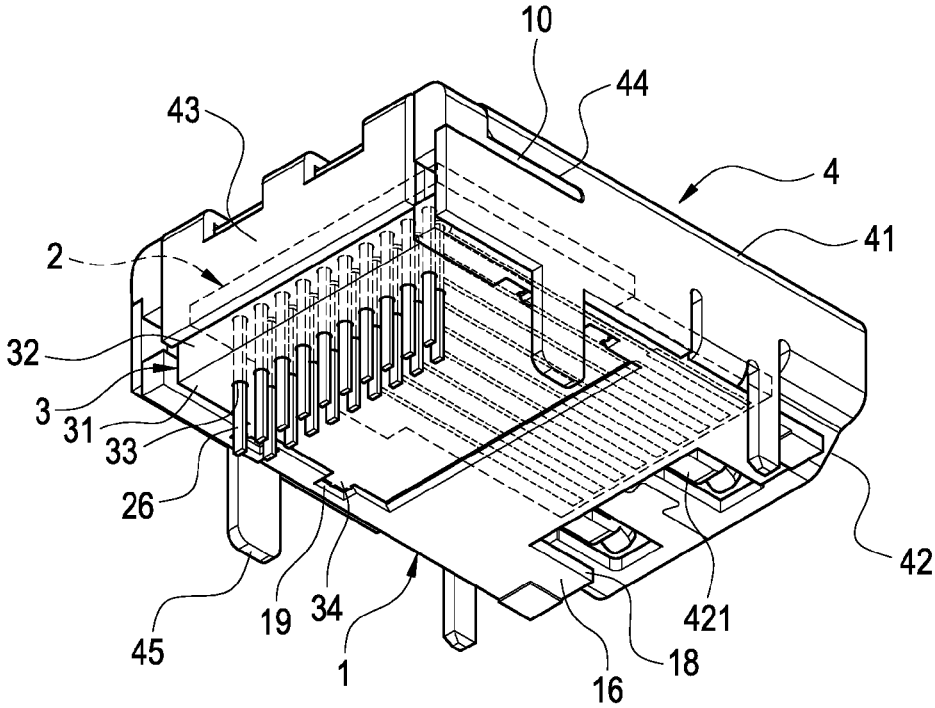
FIG. 3 is a second bottom view of a HDMI connector of the present invention.

With reference to FIGS. 1 to 3 for an exploded view and first and second bottom views of an HDMI connector structure in accordance with the present invention respectively, the HDMI connector structure comprises a base 1, a circuit board 2, a chassis 3 and a casing 4.

The base 1 is made of an insulating material and includes a containing space 11, a retaining wall 12 formed at a front end of the containing space 11, and an elongated opening 13 formed on the retaining wall 12. In addition, two ribs 14 are formed on each of two sidewalls of the containing space 11, and a slideway 15 is formed between the two ribs 14 and provided for inserting the circuit board 2 and sliding the circuit board 2 out of the opening 13. A bottom tray 16 is extended from the bottom of the retaining wall 12, and a gap 17 is formed between the retaining wall 12 and the bottom tray 16 and provided for inserting the bottom of the port 42 of the casing 4. In addition, a notch 18 is formed on the bottom tray 16 and provided for dodging an elastic plate 421 installed on the port 42 to avoid the elastic plate 421 from pressing the bottom tray 16 when the connector is used. Further, an engaging portion 19 is formed at the bottom of both sidewalls of the containing space 11 separately and provided for assembling and coupling the chassis 3. In addition, a strip-shaped fixing portion 10 is formed on both lateral sides of the base 1 and inserted and coupled into the corresponding insert slot 44 formed on both sides of the casing 4 separately.

The circuit board 2 is installed in the containing space and includes a front side 21, a back side 22, and a plurality of conductive pins (or goldfingers) 23 made of a copper foil and disposed between the front side 21 and the back side 22, and a transmission line segment 24 is extended from an end of the conductive pin 23, and the transmission line segment 24 has a soldering hole 25 formed at an end of the transmission line segment 24 and provided for soldering and coupling the conductive terminal 26.

The chassis 3 is an L-shaped object made of an insulating material and includes a tray portion 31 installed and coupled onto the base 1, a retaining portion 32 bent from an end of the tray portion 31 and coupled to a rear side of the base 1, a plurality of through holes 33 formed on the tray portion 31 and provided for passing the conductive terminals 26 out of the through holes, and a bump 34 formed on both sides of the tray portion 31 separately and coupled to the engaging portion 10.

The casing 4 is made of a metal material and includes a hollow main body 41, a port 42 formed at a front end of the main body 41 and provided for inserting a plug (not shown in the figure) of the transmission line segment, a plurality of elastic plates 421 formed at the top and bottom of the port 42 respectively, a folding plate 43 installed at an end of the hollow main body 41 and an insert slot 44 formed on both lateral sides of the hollow main body 41 separately. When the base 1 is installed in the main body 41, the fixing portion 10 is inserted into the insert slot 44, and then the folding plate 43 is bent to prevent the base 1 from being loosened or separated. In addition, an assembling pin 45 is extended from both lateral sides of the main body 41 separately and provided for electrically coupling or fixing the main body 41 with the mainboard of an electronic device (not shown in the figure).

Figure 4:
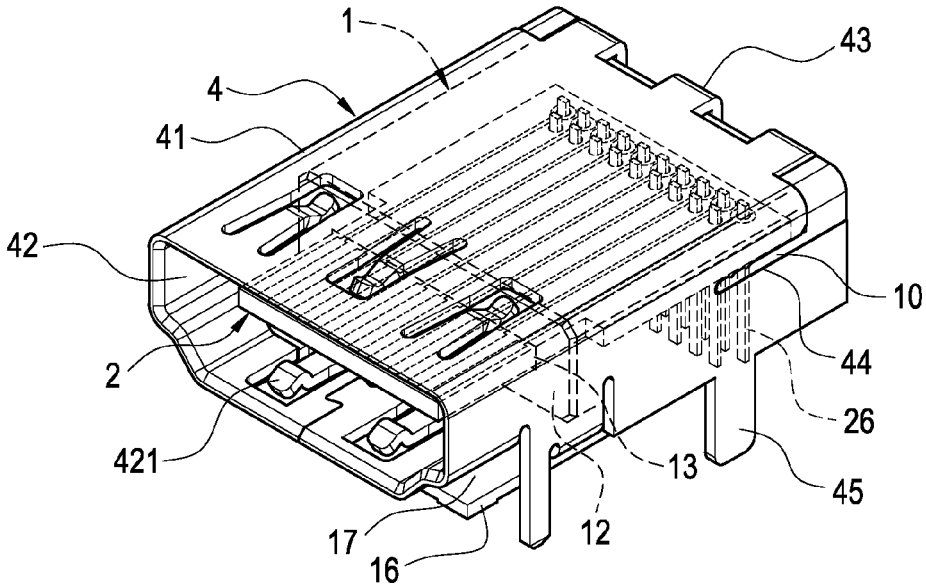
FIG. 4 is a perspective view of a HDMI connector of the present invention.
Figure 5:
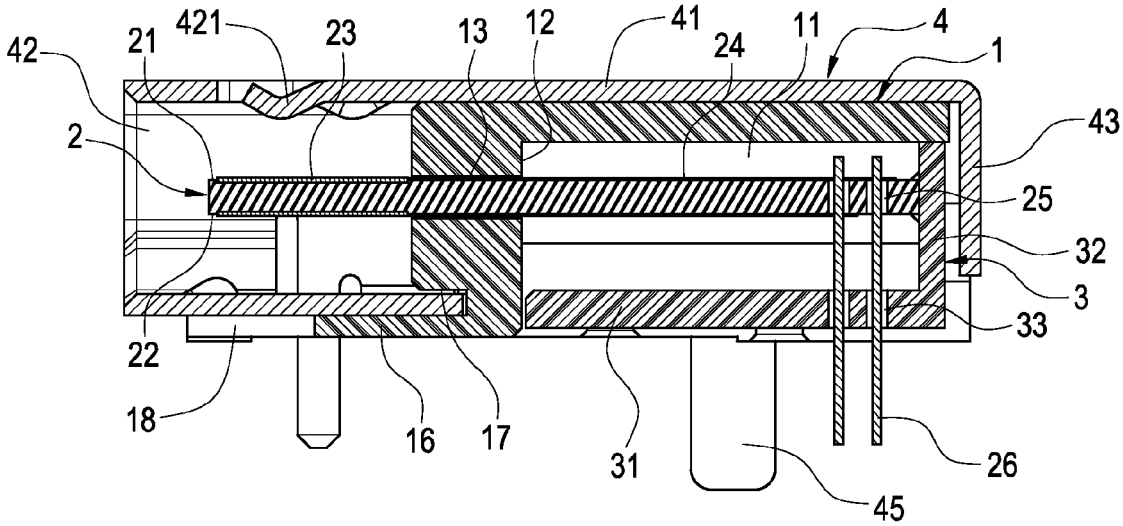
FIG. 5 is a cross-sectional view of a HDMI connector of the present invention.

With reference to FIGS. 4 and 5 for a perspective view and a cross-sectional view of a HDMI connector of the present invention respectively, when the HDMI connector is assembled, the base 1 and the casing 4 are assembled first, and then the circuit board 2 is passed from the containing space 11 through the opening 13, such that the circuit board 2 is situated in the port 42 of the casing 4.

After the base 1, the circuit board 2 and the casing 4 are assembled, the conductive terminals 26 are passed through the through holes 33 of the chassis 3 respectively to mount the chassis 3 onto the base 1, and then the folding plate 43 is installed to complete assembling the whole HDMI connector.

Figure 6:
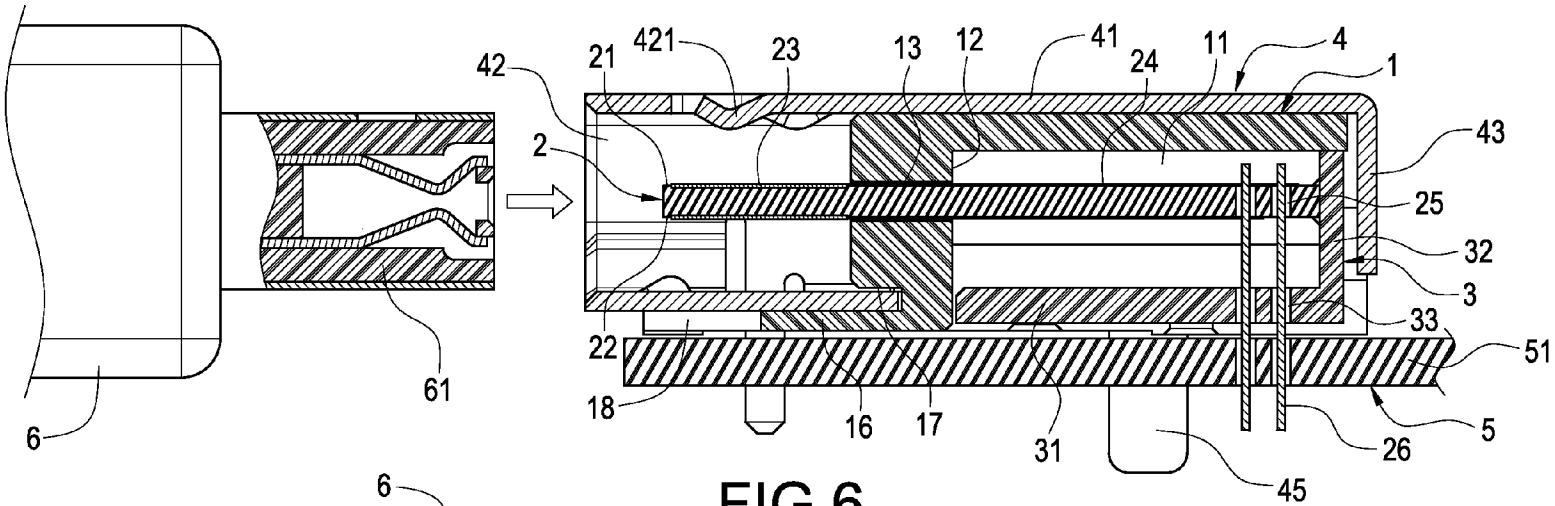
FIG. 6 is a first schematic view of an application of a HDMI connector of the present invention.
Figure 7:
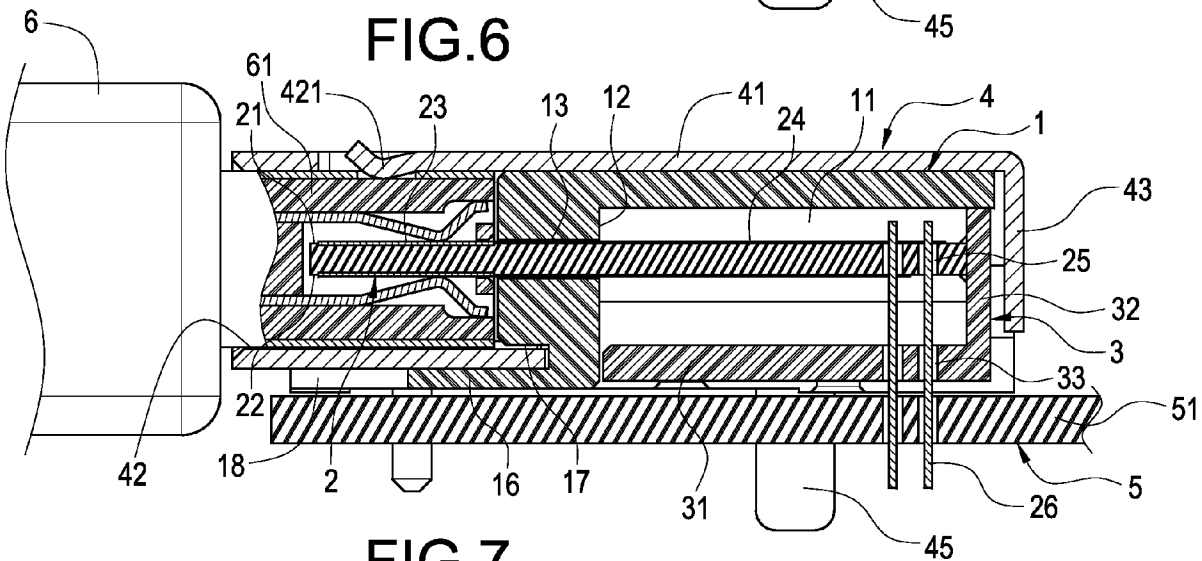
FIG. 7 is a second schematic view of an application of a HDMI connector of the present invention.

With reference to FIGS. 6 and 7 for first and second schematic views of an application of a HDMI connector of the present invention respectively, when the HDMI connector of the present invention is used, the pin 45 of the casing 4 is passed through and fixed to the mainboard 51 of the electronic device 5 or electrically coupled to the mainboard 51 of the electronic device 5, and the conductive terminal 26 is also electrically coupled to the mainboard 51.

After the HDMI connector is electrically coupled to the mainboard 51, the port 42 of the HDMI connector can be used for inserting and connecting a plug 61 of the HDMI connector transmission line 6.

Figure 8:
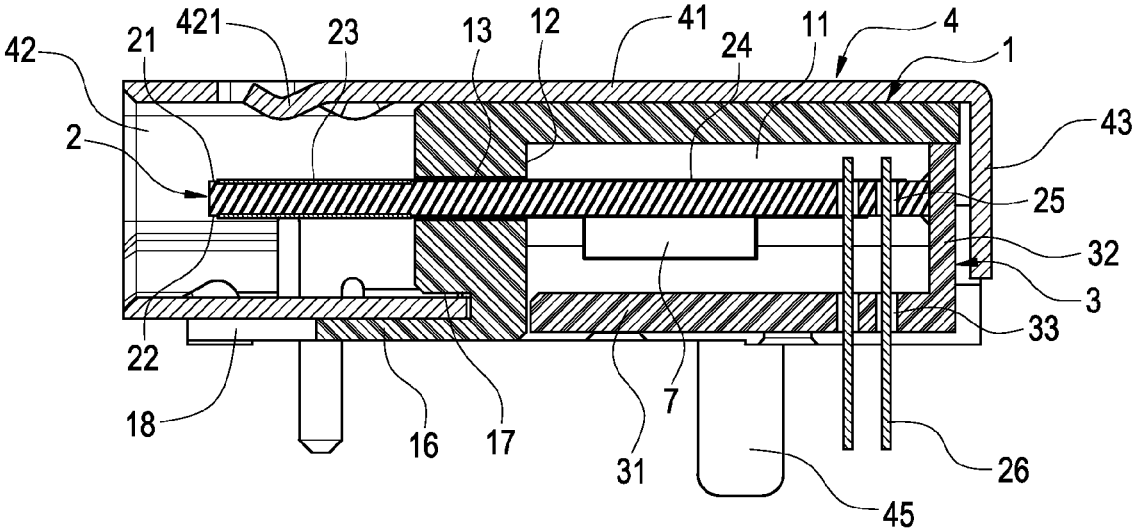
FIG. 8 is a schematic view of a HDMI connector in accordance with a preferred embodiment of the present invention.

With reference to FIG. 8 for a schematic view of a HDMI connector in accordance with a preferred embodiment of the present invention, copper foils on the circuit board 2 are used as the conductive pins 23 of the HDMI connector. In addition, when circuits, electronic components 7 or chips such as a protection circuit, a memory, a microprocessor, and a transceiver circuit are added or installed inside the HDMI connector during the production or manufacturing process, the electronic components 7 can be directly and electrically coupled onto the circuit board 2, such that the HDMI connector no longer requires an additional circuit board, so as to make the manufacture simpler and easier.

Figure 9:
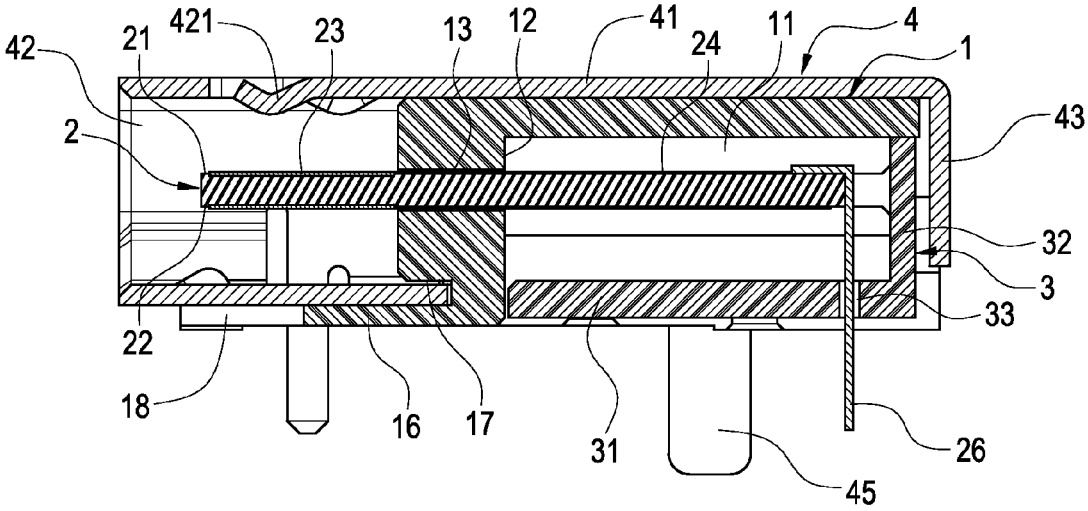
FIG. 9 is a schematic view of a HDMI connector in accordance with another preferred embodiment of the present invention.

With reference to FIG. 9 for a schematic view of a HDMI connector in accordance with another preferred embodiment of the present invention, the circuit board 2 of this embodiment does not have a soldering hole 25, but the conductive terminal 26 and the transmission line segment 24 are soldered together to save the process of manufacturing the soldering hole 25.

While the invention has been described by means of specific embodiments, numerous modifications and variations could be made thereto by those skilled in the art without departing from the scope and spirit of the invention set forth in the claims.

What is claimed is:

1. An HDMI connector structure, comprising:

a base having a containing space defined therein, a retaining wall formed at a front end of the containing space, and an opening formed on the retaining wall;

a circuit board installed in the containing space, and an end of the circuit board passing through the opening and out of the retaining wall, and the circuit board having a front side and a back side, and at least one of the front and back sides having a plurality of conductive pins, and a transmission line segment being extended from an end of the conductive pin, and ends of the plurality of transmission line segments being respectively and electrically coupled to a plurality of conductive terminals; and a casing mounted onto the exterior of the base, and having a hollow main body, and a port formed at a front end of the main body for exposing the circuit board.

2. The HDMI connector structure of claim 1, wherein the base is made of an insulating material.

3. The HDMI connector structure of claim 2, wherein the base includes a strip-shaped fixing portion formed on both lateral sides of the base separately.

4. The HDMI connector structure of claim 3, further comprising two ribs formed on both sidewalls of the containing space respectively, and a slideway formed between the two ribs for inserting the circuit board and sliding the circuit board out of the opening.

5. The HDMI connector structure of claim 3, wherein the retaining wall includes a bottom tray extended from the bottom of the retaining wall, and a gap is defined between the retaining wall and the bottom tray, and a notch is formed on the bottom tray.

6. The HDMI connector structure of claim 3, further comprising an engaging portion formed at the bottom of both sidewalls of the containing space separately.

7. The HDMI connector structure of claim 6, further comprising a chassis and the chassis being an L-shaped object made of an insulating material and having a tray portion coupled to the base, and the tray portion having a retaining portion bent from an end of the tray portion, and the retaining portion being coupled to a rear side of the base, and the tray portion further having a plurality of through holes for passing the conductive terminals out from the through holes respectively, and a bump formed on both sides of the tray portion separately and coupled to the engaging portion.

8. The HDMI connector structure of claim 5, wherein the port is assembled and coupled into the gap, and the port includes a plurality of elastic plates disposed at upper and lower peripheries of the port, and the elastic plate at the lower periphery of the port is disposed on the notch of the bottom tray.

9. The HDMI connector structure of claim 8, wherein the hollow main body includes a folding plate formed at an end of the main body, and an assembling pin extended from both lateral sides of the main body separately.

10. The HDMI connector structure of claim 1, wherein the conductive pins are copper foils disposed on the circuit board.

11. The HDMI connector structure of claim 9, wherein the conductive pins are goldfingers.

12. The HDMI connector structure of claim 9, wherein the circuit board includes an electronic component electrically coupled to the circuit board.

13. The HDMI connector structure of claim 9, wherein the circuit board further includes an electronic circuit installed thereon.

14. The HDMI connector structure of claim 1, wherein the circuit board includes a plurality of soldering holes formed thereon, and electrically coupled to an end of the transmission line segment and the conductive terminals.

* * * * *